US005839042A

United States Patent [19]

Tomatsu

[11] Patent Number: 5,839,042

[45] Date of Patent: Nov. 17, 1998

[54] FIXING DEVICE IN IMAGE FORMING DEVICE

[75] Inventor: Yoshiya Tomatsu, Kasugai, Japan

[73] Assignee: Brother Kogyo Kabushiki Kaisha, Nagoya, Japan

[21] Appl. No.: 852,606

[22] Filed: May 7, 1997

[30] Foreign Application Priority Data

| | | | |
|---|---|---|---|
| May 8, 1996 | [JP] | Japan | 8-113547 |
| May 8, 1996 | [JP] | Japan | 8-113549 |
| May 8, 1996 | [JP] | Japan | 8-113550 |
| May 9, 1996 | [JP] | Japan | 8-115034 |
| May 9, 1996 | [JP] | Japan | 8-115035 |

[51] Int. Cl.[6] ..... G03G 15/20

[52] U.S. Cl. ..... 399/328

[58] Field of Search ..... 399/320, 333, 399/330, 328; 219/469–471

[56] References Cited

U.S. PATENT DOCUMENTS 5,528,345 6/1996 Hasegawa .

5,729,813 3/1998 Eddy et al. ..... 399/333

FOREIGN PATENT DOCUMENTS

A-8-6416 1/1996 Japan .

*Primary Examiner*—S. Lee

*Attorney, Agent, or Firm*—Oliff & Berridge, PLC

[57] ABSTRACT

A fixing device having a heat roller and a pressure roller in nipping relation therewith. The heat roller includes a metallic sleeve member and a halogen lamp disposed in a hollow space of the sleeve member. The pressure roller includes a core member and an elastic rubber layer formed over the core member. The sleeve member provides a moment of inertia of area ranging from 700 $mm^4$ to 1700 $mm^4$ and a maximum deflection amount of not more than 0.29 at the longitudinal center. Further, the sleeve member provides a thermal capacity of not more than 0.035 J/K.

30 Claims, 12 Drawing Sheets

FIG. 13

PRESSURE ROLLER : DIAMETER 16mm, PRESSURE 5kgf
HEAT ROLLER : LENGTH 245mm, DIAMETER 16.5mm, THICKNESS 0.6mm

| RUBBER HARDNESS (JISA) | DIAMETER OF CORE MEMBER (mm) | | | | |
|---|---|---|---|---|---|
| | 7 | 8 | 9 | 10 | 11 |
| 8 | × | △ | △ | △ | ○ |
| 12 | × | ○ | ○ | ○ | ◎ |
| 15 | △ | ○ | ◎ | ◎ | ◎ |
| 20 | △ | ○ | ◎ | ◎ | ◎ |
| 22 | △ | ◎ | ◎ | ◎ | ◎ |

◎ .... SLIGHT AMOUNT OF CURL
○ .... MODERATE CURL
△ .... CURL OF SMALL RADIUS OF CURVATURE
× .... CURL OF EXTREMELY SMALL REDIUS OF CURVATURE

FIG. 14

PRESSURE ROLLER : DIAMETER 16mm, PRESSURE 5kgf
HEAT ROLLER : LENGTH 245mm, DIAMETER 16.5mm, THICKNESS 0.6mm

| RUBBER HARDNESS (JISA) | DIAMETER OF CORE MEMBER (mm) | | | | |
|---|---|---|---|---|---|
| | 7 | 8 | 9 | 10 | 11 |
| 8 | ◎ | ◎ | ◎ | ○ | △ |
| 12 | ◎ | ◎ | ◎ | ○ | △ |
| 15 | ◎ | ○ | ○ | ○ | △ |
| 20 | ○ | ○ | ○ | ○ | △ |
| 22 | ○ | △ | △ | △ | × |

◎ •••• EXCELLENT
○ •••• GOOD
△ •••• NO GOOD
× •••• BAD

FIG. 15

PRESSURE : 5kgf
CONSUMED POWER OF HALOGEN LAMP : 40W
HEAT ROLLER : LENGTH 245mm, DIAMETER 16mm, THICKNESS 0.6mm

| OUTER DIAMETER OF PRESSURE ROLLER (mm) | FIXING QUALITY | CURL |
|---|---|---|
| 14 | × | ○ |
| 15 | △ | ○ |
| 16 | ○ | ○ |
| 16.5 | ◎ | ◎ |
| 17 | ○ | ○ |
| 18 | ○ | ○ |
| 19 | ○ | ○ |
| 20 | ○ | ○ |
| 21 | ○ | △ |
| 22 | ○ | × |

◎ •••• EXCELLENT ○ •••• GOOD
△ •••• NO GOOD × •••• BAD

FIXING DEVICE IN IMAGE FORMING DEVICE

BACKGROUND OF THE INVENTION

The present invention relates to a fixing unit for use in an image forming device, such as a copying machine, facsimile machine, and laser printer for thermally fixing a toner image formed on an image recording medium such as a sheet.

A conventional electrostatic image forming device is disclosed in Japanese Patent Application Kokai (OPI) No. HEI-8-6416. According to the device, a scanner unit is provided for irradiating a laser beam onto a surface of a photosensitive drum so as to form an electrostatic latent image on the photosensitive drum. Toner supplied from a toner cartridge is electrostatically adhered to the latent imaging area, so that a visible toner image is developed on the drum. Then, the toner image is transferred onto a recording sheet which is passed along an image transfer portion of the drum. The toner image transferred onto the sheet is then fixed at a thermal fixing unit, i.e., at a thermally fixing portion or nip portion provided between a pressure roller and a heat roller. Finally, the recording sheet with the fixed toner image is discharged out of an outer body frame by a pair of rollers, that is, a discharge roller and a pinch roller.

In order to securely fix the toner image on the surface of the sheet such that the toner will not fall off, the nip portion should provide a sufficient nipping width. To this effect, conventionally, the pressure roller is formed of a metal sleeve coated with a rubber layer, and the heat roller includes a cylindrical metal sleeve and a halogen lamp serving as a heat generating element disposed in the metal sleeve. The pressure roller presses against the heat roller. This pressure is applied to the pressure roller at axial end portions thereof where the pressure roller is held. Therefore, the pressure roller and the heat roller nip the sheet. Because the rubber coated pressure roller presses against the metal surface of the heat roller, the nip portion has a certain amount of width in a sheet feeding direction. The heat generating element is adapted for providing uniform heating temperature along entire axial length of the heat roller. Because of the desired nipping width, the thermal fixing operation can be made with a predetermined toner fixing force which prevents the toner from being released from the sheet.

However, because both the pressure roller and the heat roller are simply supported at their both axial ends, a maximum deformation occurs on axially center portions of both the pressure roller and the heat roller. As a result, the recording sheet passed through the such nip portion may be curled. Further, elongated wrinkles extending the feeding direction of the sheet may be formed at a widthwise center portion of the paper sheet in case of excessive deformation of the rollers.

Further, if the nipping width is exceedingly large, the sheet may be curled up or rolled around the outer peripheral surface of the heat roller (The nipping width implies a contacting length between the pressure roller and the heat roller in a direction perpendicular to the roller axis). In order to avoid this problem, an outer diameter of the pressure roller is formed smaller than that of the heat roller. In this way, the nip portion has an adequate nipping width capable of avoiding curling of the sheet around the heat roller.

Further, in order to solve the above described problems, the pressure roller may be formed in a normal crown shape which implies a pipe shape having a larger outside diameter at the center than at the edges. Alternatively, the pressure roller is in the form of a cylindrical shape having a uniform diameter along its length whereas the heat roller is formed in an inverted crown shape in which the diameter of the axially center portion is minimum and the diameter at the axially end portions is maximum.

In another aspect, the image forming device is not operable unless the fixing unit is at an operating temperature. If prolonged preheating temperature is required, image forming operation cannot be started at an early stage after turning ON a main switch. In order to reduce the preheating period, a hollow cylinder is formed of a metal having high thermal conductivity, and a heat generating element such as a halogen lamp is inserted into the hollow cylinder to provide the heat roller.

However, if the hollow cylinder or the heat roller is formed in the inverted crown shape, the thickness of the hollow cylindrical mass of the heat roller cannot be extremely thin. For example, the minimum thickness of the hollow cylindrical wall of the heat roller is about 2 mm. Further, because the heat generating element must generate great thermal energy, which increases electric consumption, and it is uneconomical. Therefore, it would be rather difficult to effectively reduce the start-up period of the image forming device. Moreover, the heat roller must be formed in the normal crown shape if large pressing force is imparted on the heat roller from the pressure roller. In addition, forming the thermal roller in the crown shape increases the manufacturing cost.

In order to fulfill the requirement of reducing the start-up period while maintaining the diametrical relationship such that the outer diameter of the pressure roller is smaller than that of the heat roller, the diameter of the heat roller must be decreased. In this case, the outer diameter of the pressure roller must further be decreased, which in turn reduces nipping width. This causes extremely poor fixation of the toner image on the surface of the sheet.

On the other hand, if the diameter of the pressure roller is made larger than that of the heat roller, the warming up period can be shortened by decreasing the diameter of the heat roller. However, this causes another problem. That is, if the diameter of the pressure roller is far greater than that of the heat roller, a contact area between one surface of the sheet and the pressure roller becomes greatly different from a contacting area between another surface of the sheet and the heat roller when the sheet is nipped between the pressure roller and the heat roller. That is, friction force at one surface of the sheet opposing the rubber layer becomes much different from that at the other surface thereof opposing the metal cylinder. As a result, the sheet is pulled by the pressure roller, and slips at the surface of the heat roller. Consequently, a scratched portion may be formed in the toner image, and imaging quality may be degraded.

Further, if the diameter of the heat roller is excessively reduced or the wall thickness thereof is excessively reduced, rigidity of the heat roller is lowered. Therefore, deforming amount at the axially center portion of the heat roller becomes increased by the pressure from the pressure roller. As a result, the nipping width at the axially center portion of the heat roller is greatly smaller than that at the axially end portions thereof, and if the difference in the nipping widths becomes excessively large, the sheet curls greatly at the large nipping width portions, that is, the axially end portions of the heat roller. Also, the toner imaging quality may be varied in a direction perpendicular to the sheet feeding direction due to the difference in toner fixing strength.

In still another aspect, in order to provide a compact image forming device, a diameter of the pressure roller should be reduced, and wall thickness of the heat roller should be small. However, in such a case, these rollers may become more deformable, and maximum deformation of the rollers occurring at the axially center portion thereof is further increased due to decrease in rigidity. As a result, the difference between width of the nipping areas at the center and that at the axially end portions becomes exceedingly large. Consequently, the above described sheet curling and wrinkle may be promoted.

In still another aspect, hardness of the rubber layer of the pressure roller also affects image forming performance. If the rubber layer has low hardness, the width of the nip portion in the sheet feeding direction becomes large, thereby exceedingly curling the discharged sheet. On the other hand, if the rubber layer provides high hardness, insufficient width of the nip portion results, which weaken the toner fixing force to the sheet during thermal fixing operation, and as a result, the toner image fixed on the sheet may be peeled off.

SUMMARY OF THE INVENTION

The present invention has been provided by utilizing a phenomenon in which the heat roller having a thin wall thickness is deformed into the inverted crown shape if the pressure roller applies an adequate pressure to the heat roller.

It is an object of the present invention to provide a fixing unit capable of stabilizing a fixing operation and being manufactured at a low cost.

Still another object of the present invention is to provide the fixing unit which requires less waiting time at the initial starting up period, and provides less occurrence in sheet curling and less electric consumption.

These and other objects of the present invention will be attained by a fixing device for thermally fixing a toner image formed on an image recording medium, the fixing device including a heat roller and a pressure roller. The heat roller includes a sleeve member formed of a metal. The sleeve member has an inner hollow space and defines a longitudinal center. A heating element is provided in the hollow space. The sleeve member provides a moment of inertia of area ranging from 700 $mm^4$ to 1700 $mm^4$ and a maximum deflection amount of not more than 0.29 at the longitudinal center. The pressure roller is in pressure contact with the heat roller for nipping the image recording medium between the heat roller and the pressure roller.

In another aspect of the invention, there is provided a fixing device for thermally fixing a toner image formed on an image recording medium. The fixing device includes the pressure roller and a heat roller having a thin sleeve member and a heating element. The thin sleeve member is formed of a metal and has an inner hollow space. The heating element is provided in the hollow space. The sleeve member provides a moment of inertia of area ranging from 700 $mm^4$ to 1700 $mm^4$ and a thermal capacity of not more than 0.035 (J/K).

BRIEF DESCRIPTION OF THE DRAWINGS

In the drawings:

FIG. 9(*b*) is a view for description of a temperature distribution or gradient at an outer peripheral surface of the heat roller;

FIG. 9(*c*) is a view for description of a light intensity distribution or heat intensity distribution of a halogen lamp installed in the heat roller;

FIG. 9(*d*) is a plan view showing the halogen lamp;

FIG. 13 is a view for determining allowable range of an outer diameter of a core member and rubber hardness of the pressure roller, the range being capable of reducing sheet curling;

FIG. 14 is a view for determining allowable range of the outer diameter of the core member and rubber hardness of the pressure roller, the range being capable of providing sufficient image fixing quality; and FIG. 15 is a view for determining allowable range of the outer diameter of the pressure roller in terms of Image fixing quality and occurrence in sheet curling.

DETAILED DESCRIPTION OF THE PREFERRED EMBODIMENTS

A fixing unit according to one embodiment of the present invention will be described with reference to the accompanying drawings which illustrate a laser printer embodying the present invention.

Figure 1:
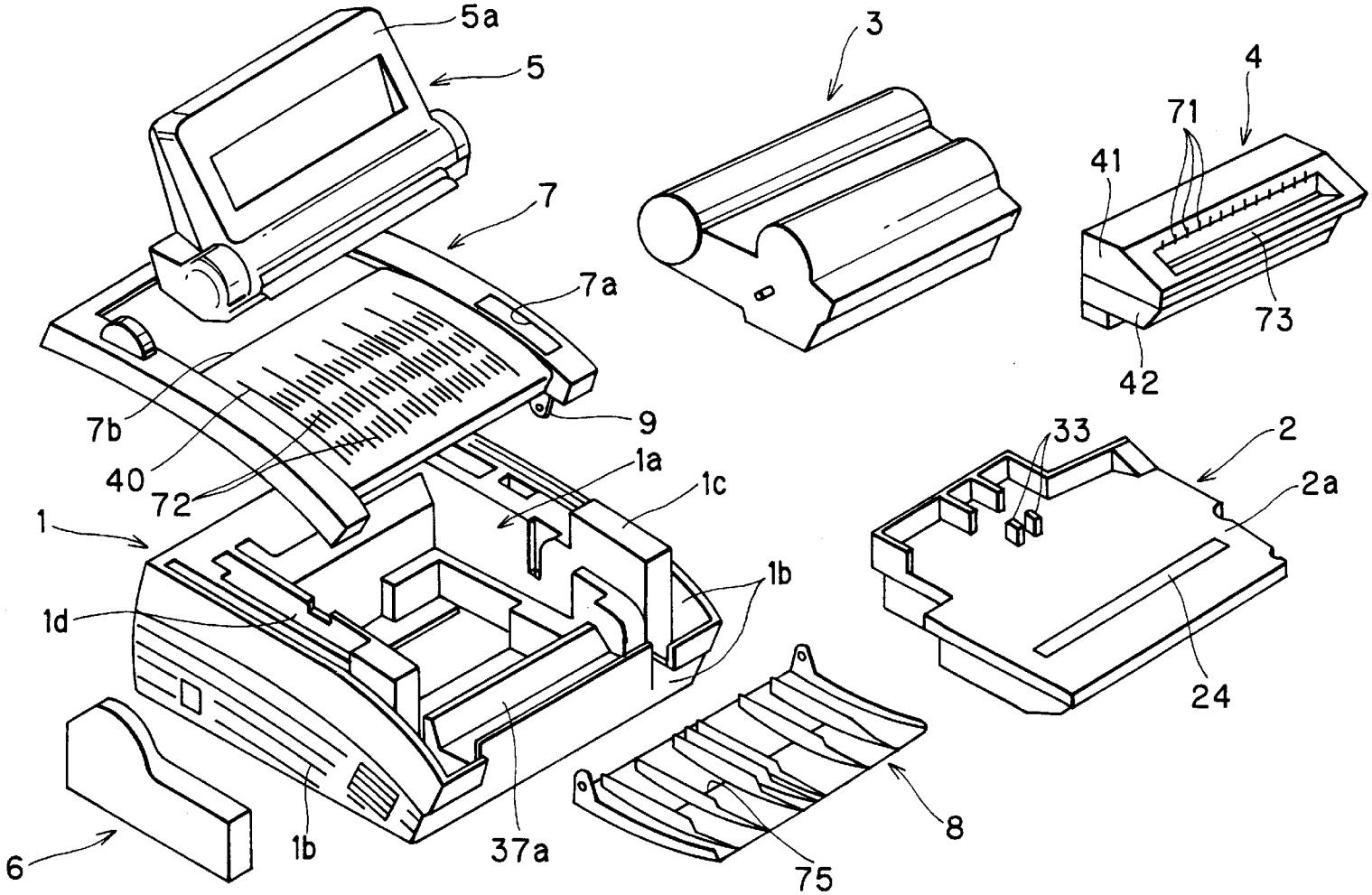
FIG. 1 is an exploded perspective view showing respective essential units in a laser printer according to one embodiment of the present invention.

The laser printer includes a main body 1 made of synthetic resin and having a main frame 1*a* and a main cover 1*b* as shown in FIG. 1. The main frame 1*a* has a box shape and has an upper open end. The main frame 1*a* accommodates therein a scanner unit 2 as an exposure unit, a process unit 3 serving as toner image forming means, a fixing unit 4 and a sheet feed unit 5. These units can be installed in the main frame 1*a* from its upper opening. The main cover 1*b* serves to cover the four sides (front and rear sides and right and left sides) of the main frame 1*a*. The main frame 1*a* and the main cover 1*b* are integrally formed with injection molding or the like.

A drive system unit 6 including a drive motor and a gear train is disposed into an accommodation recess 1*d* defined in FIG. 1 between the left side inner surface of the main cover 1*b* and the left side of the main frame 1*a* adjacent thereto. The drive system unit 6 is inserted into the accommodation recess 1*d* through its lower opening.

A top cover 7 made of synthetic resin is in the form of a body cover for covering the upper open end of the main frame 1*a* and the main cover 1*b*. The top cover 7 is formed with an opening 7*a* which allows an operation panel 1*c* to extend therethrough. The operation panel 1*c* protrudes upwardly from the right side of the main frame 1*a*. The top cover 7 is also formed with an opening 7*b* through which a base end of the sheet feed unit 5 extends. A plurality of air outlets 40 is formed in the top cover 7 so as to allow cooling air to discharge therethrough. Further, a base end of a discharge tray 8 is mounted pivotally up and down to a couple of brackets 9 (one of which is visible) projectingly provided on opposite ends at the front edge of the top cover 7. The arrangement is such that when the discharge tray 8 is not used, the discharge tray 8 is collapsible toward and seated on the upper surface side of the top cover 7.

The sheet feed unit 5 includes a feeder case 5*a* in which sheets P are accommodated in a stacked manner. A sheet feed roller 11 is rotatably disposed in the sheet feed unit 5, and a support plate 10 is urgedly disposed toward the sheet feed roller 11 by a biasing spring 10*a* disposed within the feeder case 5*a*. The sheet feed roller 11 is drivingly rotated by the drive system unit 6. Further, a separation pad 12 is disposed in confronting relation with the sheet feed roller 11. Thus, Leading edges of sheets of paper P are pressed toward the sheet feed roller 11 by the support plate 10, and are separated one by one by the separation pad 12 and the sheet feed roller 11.

The thus separated sheet of paper P is delivered to the process unit 3 by means of a pair of upper and lower resist rollers 13, 14 for forming a toner image on top of the surface of the sheet of paper P in the process unit 3. The image is fixed by a heat roller 15 and a pressure roller 16 of the fixing unit 4 which will be described in detail later, and then the sheet of paper P carrying the fixed image is discharged onto the discharge tray 8 by way of a sheet discharge unit including a discharge roller 17 and a pinch roller 18 which are located downstream of the heat roller 15 and the pressure roller 15 within a fixing unit case.

The process unit 3 is located in substantially the middle, when viewed in plan view, of the main frame 1*a*. At a position below the process unit 3, an upper support plate 2*a*of the scanner unit 2 is secured by means of screws (not shown) to a stay section (not shown) integrally projecting upwardly from a bottom plate of the main frame 1*a*. The upper support plate 2*a* is made of a synthetic resin, and essential components of the scanner unit 2 are disposed below the upper support plate 2*a*.

The scanner unit 2 serving as the exposure unit includes a laser emitting section, a polygon mirror 20, a lens 21, a reflection mirror 22, etc. The upper support plate 2*a* is formed with a transversely elongated scanner aperture. The aperture extends in a direction parallel with an axial direction of a photosensitive drum 23 of the process unit 3. Further, a glass plate 24 is provided for covering the aperture. A laser beam irradiated from the laser emitting section passes through the glass plate 24 and the aperture and reaches the peripheral surface of the photosensitive drum 23 of the process unit 3 for exposing the photosensitive drum 23 to the laser beam.

Figure 2:
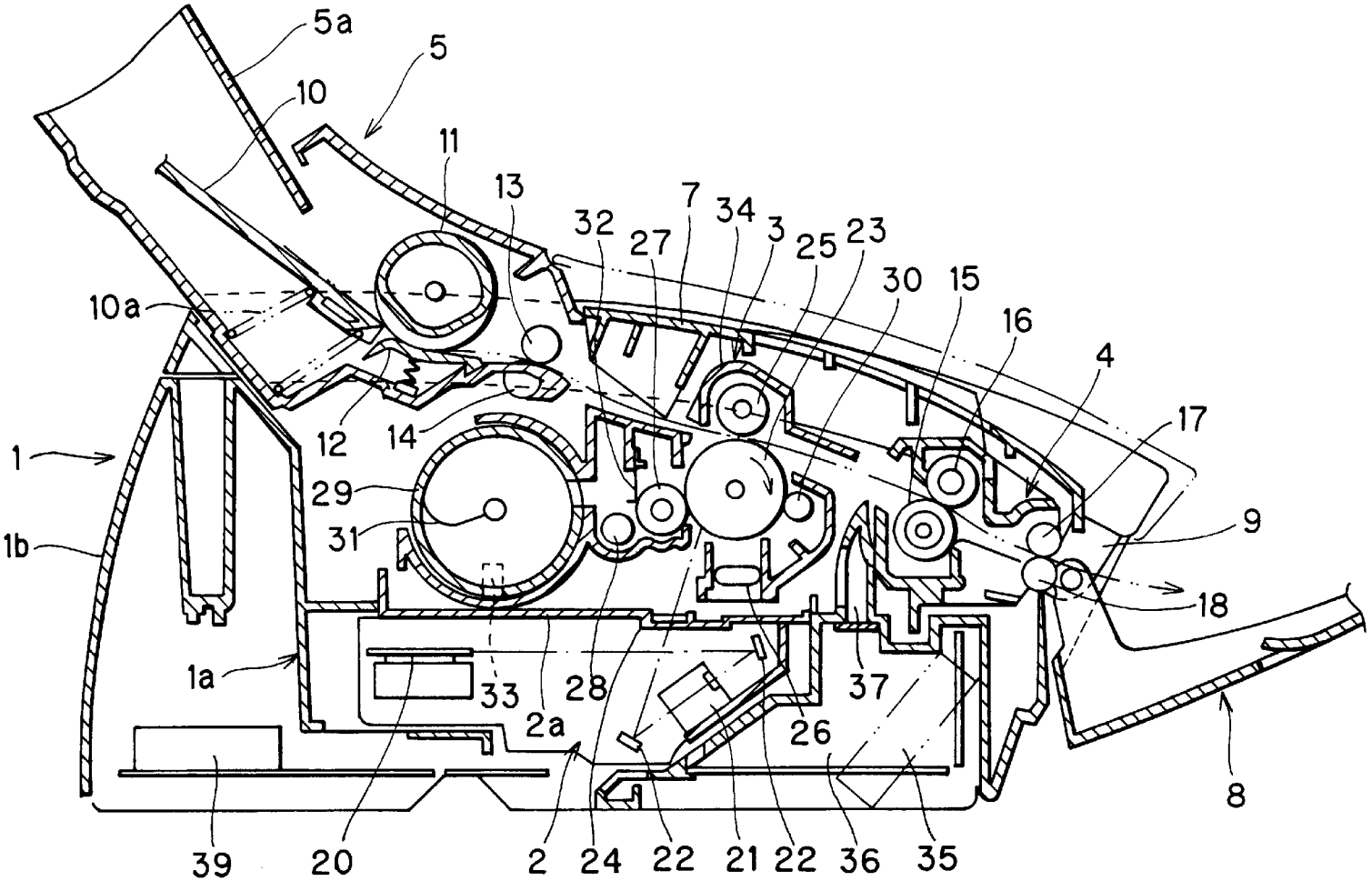
FIG. 2 is a cross-sectional view showing an internal arrangement of the laser printer according to the embodiment.

As shown in FIG. 2, the process unit 3 includes the photosensitive drum 23, a transfer roller 25 positioned thereabove and in nipping relation therewith, a scorotoron charger 26 positioned below the photosensitive drum 23, a developing unit disposed upstream of the photosensitive drum 23 in the paper feed direction and having a developing roller 27 an a toner supply roller 28, a toner cartridge 29 disposed on the upstream side of the developing unit and serving as a development agent (toner) supply section, and a cleansing roller 30 disposed downstream of the photosensitive drum 23. The entire process unit 3 is incorporated into a case 34 made of a synthetic resin to make a cartridge. The process unit 3 in the form of a cartridge is removably attached to the main frame 1*a*.

An electrostatic latent image is formed on the outer periphery of the photosensitive drum 23 by scanning with the scanner unit 2 while charging the peripheral surface of the photosensitive drum 23 by the charger 26. The developing agent or the toner accommodated in the toner cartridge 29 is stirred by an agitating element 31 and discharged from the toner cartridge 29. The toner is then carried on the outer periphery of the developing roller 27 by means of the toner supply roller 28. The thickness of the toner layer formed on the developing roller 27 is regulated by a blade 32. The electrostatic latent image on the photosensitive drum 23 becomes visible by the adhesion of the toner supplied from the developing roller 27. The visible toner image is then transferred onto the sheet of paper P passing through the nip between the transfer roller 25 and the photosensitive drum 23. Then, the toner remaining on the photosensitive toner 23 is temporarily collected by the cleaning roller 30 and then returned onto the photosensitive drum 23 at a predetermined timing. Then the toner on the photosensitive drum 23 is collected into the interior of the process unit 3 by means of the developing roller 27.

The upper support plate 2*a* of the scanner unit 2 is provided with an upwardly protruding toner sensor 33 consisting of a light emitting portion and a light receiving portion. Further, the toner cartridge 29 has a bottom portion formed with a recess. The toner sensor 33 is positioned within the recess for detecting the presence or absence of the toner within the toner cartridge 29.

On the bottom surface side of the junction between the front portion of the main frame 1*a* and the front portion of the main cover 1*b*, there are provided an accommodation section 36 for accommodating a cooling fan 35 and a ventilation duct 37 transversely extending in the direction orthogonal to the passing direction of the sheet of paper P. The accommodation section 36 and the ventilation duct 37 are fluidly connected to each other. The ventilation duct 37 is defined by an upper plate portion 37*a* having a V-shape in section, and is formed with a plurality of slits 38 open to the process unit 3. The upper surface portion 37*a* is positioned between the process unit 3 and the fixing unit 4 so as to prevent heat generated from the heat roller 15 in the fixing unit 4 from being directly transmitted to the process unit 3.

A cooling air generated by the cooling fan 35 passes through the interior of the ventilation duct 37 and then passes along a bottom surface of the main frame 1*a* to cool a power supply source 39 (see FIG. 2) and a drive motor (not shown) of the drive system unit 6. The power supply source 39 is positioned at the rear part of the main frame 1. Simultaneously, the cooling air ejects through the plurality of slits 38 toward the process unit 3, and then upwarly moves through a gap between the process unit 3 and the fixing unit 4. The cooling air is then discharged through the plurality of air outlets 40 formed in the top cover 7. This arrangement will provide a function of an air curtain for preventing steam generated in the fixing unit 4 from being directed toward the process unit 3 and toward the sheet feed unit 5.

Referring to FIGS. 3 to 11, description will be given of detailed structure of the fixing unit 4.

The fixing unit 4 has a case made of a heat resistant synthetic resin. The case includes an upper case 41 and a lower case 42 (FIG. 1), disengageably coupled together by means of engagement clicks (not shown) at right and left end portions thereof.

The pressure roller 16 has a central core member 50 made of a metal, right and left end shafts 52, and an elastic layer 51 formed over the core member 50. The elastic layer 51 is made of an elastic material such as flexible heat-resistant rubber.

Figure 7:
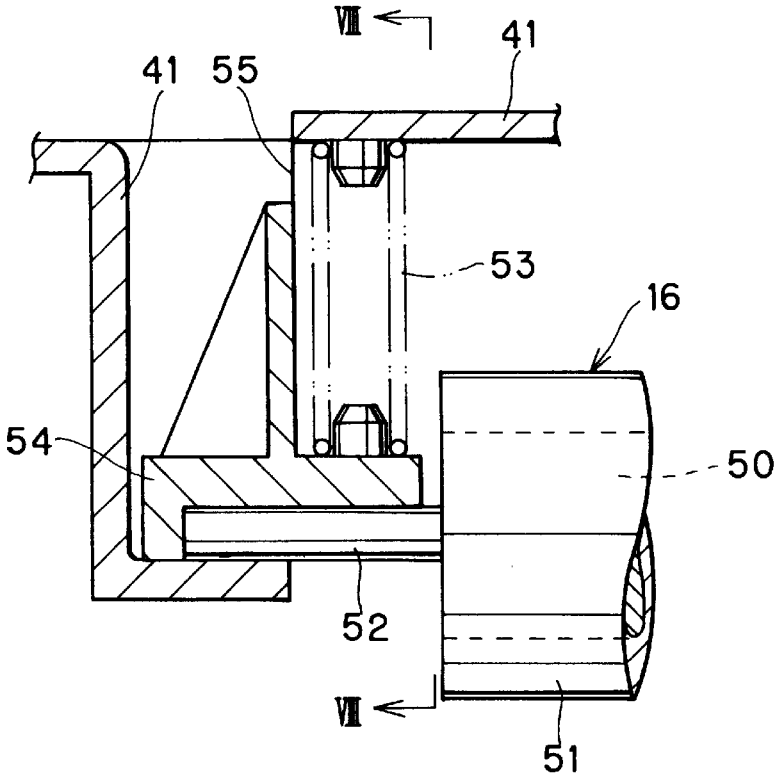
FIG. 7 is a cross-sectional view showing a pressure mechanism for urging a pressure roller toward a heat roller according to the embodiment of this invention.
Figure 8:
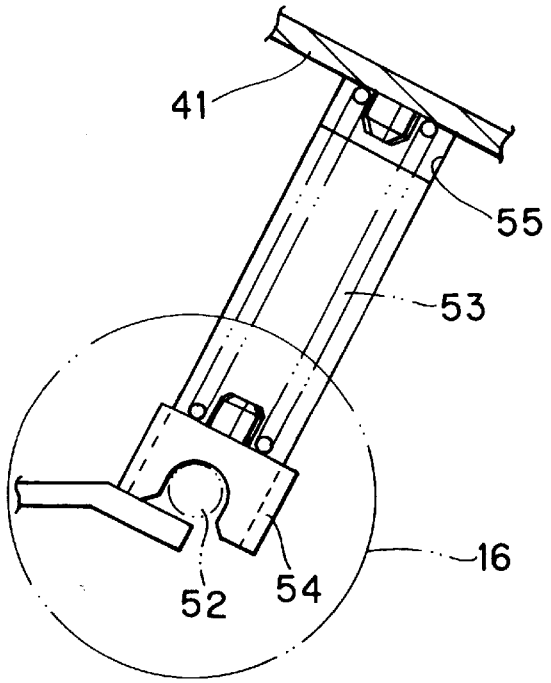
FIG. 8 is a cross-sectional view taken along the line VIII—VIII of FIG. 7.
Figure 10:
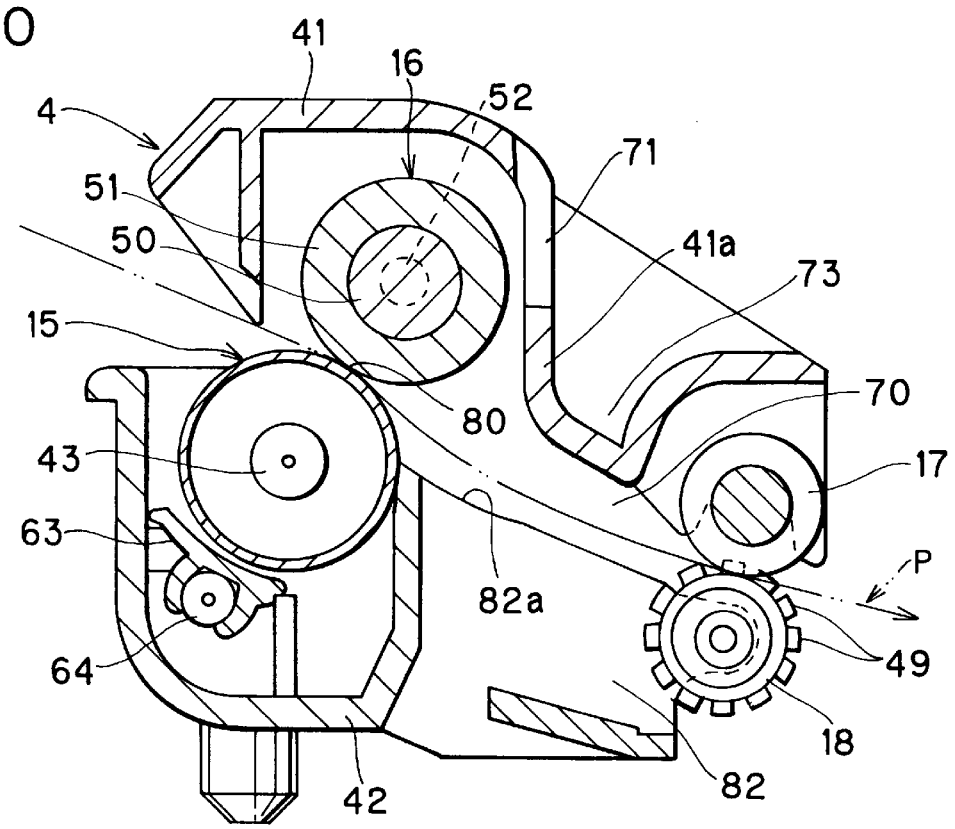
FIG. 10 is a cross-sectional view taken along the line X—X of FIG. 4.

As best shown in FIGS. 7 and 10, the pressure roller 16 is disposed in the upper case 41. More specifically, the right and left end shafts 52 are rotatably mounted on a bottom wall of the upper case 41, and the right and left end shafts 52 are held at positions by biasing spring 53 and a bearing 54 made of synthetic resin. The biasing spring 53 and the bearing 54 are positioned in an attachment hole 55 defined by the upper case 41, and the bearing 54 is vertically displaceable and is urged onto the end shafts 52 by the biasing spring 53. Further, the bearing 54 is incapable of dropping off relative to attachment holes 55. Therefore, the lower peripheral portion of the pressure roller 16 is at all times pressed and urged against the top peripheral portion of the heat roller 15.

On an upstream side, in the direction of feed of sheets of paper P, of the lower case 42, the heat roller 15 is disposed. The heat roller 15 includes a hollow metallic sleeve member made of a material having a sufficient heat conductivity such as aluminum and an elongated tubular halogen lamp 43 disposed within a hollow space of the sleeve member. The heat roller 15 is rotatably supported to the lower case 42 by bearings 44 which is in the form of a ring and made of synthetic resin such as PPS (polyphenylene sulfide).

A drive gear 45 is fixedly coupled to one end of the heat roller 15. The drive gear 45 is made of a synthetic resin, and more specifically, thermoplastic synthetic resin material having sufficient heat resistance, high strength and lower heat conductivity than metal. Typical thermoplastic resin is PPS (polyphenylene sulfide) having melting point of 280° C. heat conductivity 0.007(cal/cm·sec·°C.). A glass reinforced composite material is preferable as the material of the drive gear 45, which is produced by mixing glass short fibers with the synthetic resin and injection molding the mixture.

Figure 5:
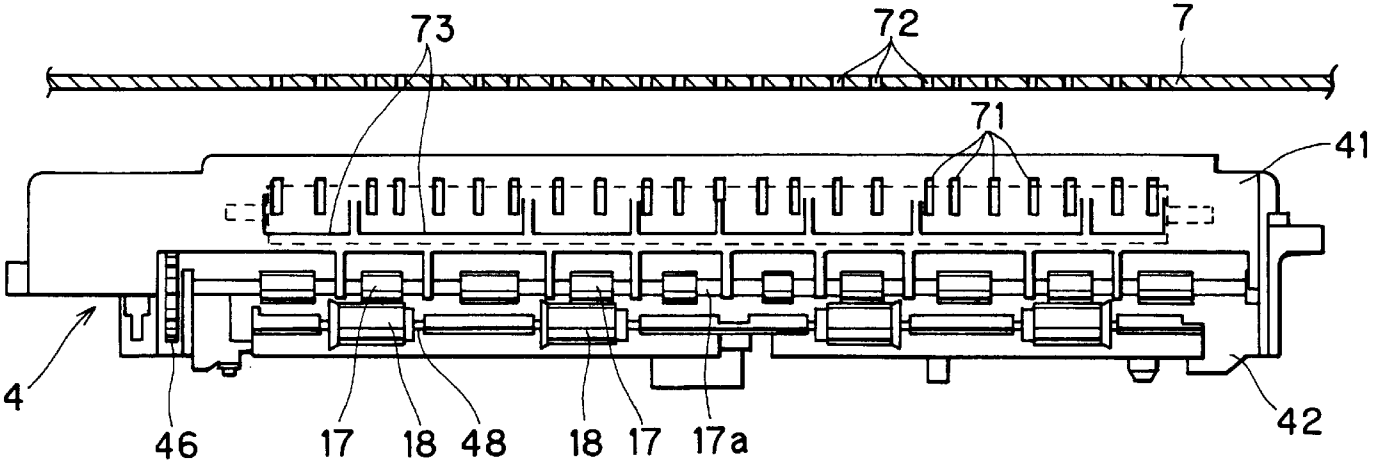
FIG. 5 is a cross-sectional view taken along the line V—V of FIG. 4.

Further, sheet discharge roller pair such as the discharge roller (upper rollers) 17 and the pinch roller (lower roller ) 18 are rotatably disposed in the upper and lower cases 41, 42 at a position downstream of the heat roller 15 and the pressure roller 16 in the sheet feeding direction. The discharge roller 17 has one end provided with a driven gear 46 (FIG. 5). The sheet discharge roller 17 is divided into a plurality of roller sections and each section is provided integrally with a rotation shaft 17*a*. The pinch roller 18 is also divided into a plurality of roller sections, and each roller section of the pinch roller 18 is rotatably supported by a shaft 48 and is resiliently connected thereto by a coiled spring.

A power transmission mechanism (not shown) is provided for transmitting driving power of the drive system unit 6 to the drive gear 45. Further, a couple of intermediate gears 47 (one of which is visible in FIG. 4) are provided for transmitting rotation of the drive gear 45 to the driven gear 46. Thus, the discharge roller 17 is rotated in synchronism with the heat roller 15.

Figure 3:
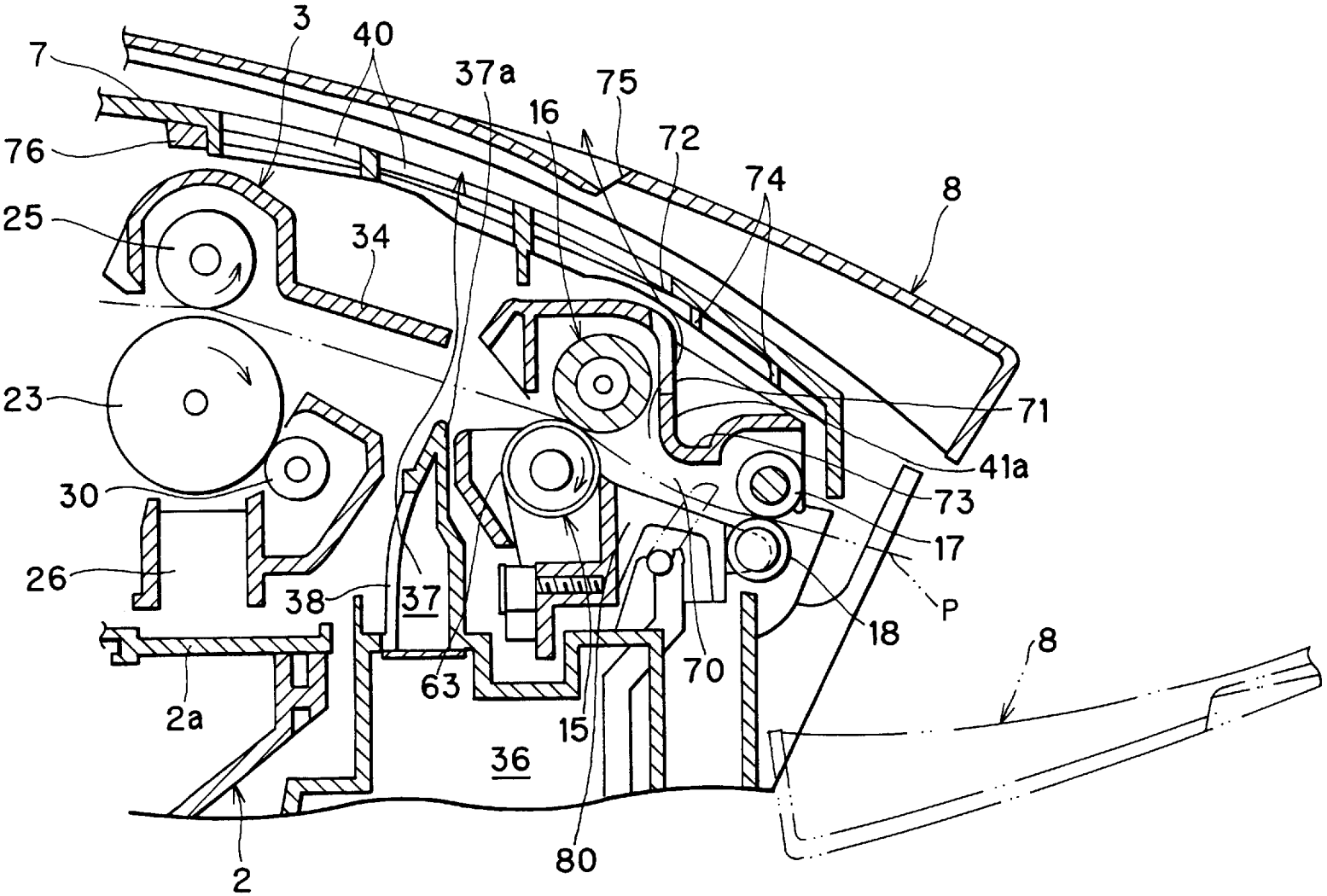
FIG. 3 is a cross-sectional view showing particularly a fixing unit of the laser printer according to the embodiment.

An upper wall of an intermediate portion of the upper case 41 is downwardly convexed as shown in FIGS. 3 and 10. With this arrangement, in the fixing unit case, at least the upper space of a sheet delivery path 70 between the fixing part consisting of the heat roller 15 and the pressure roller 16 and the paper discharge part positioned downstream thereof and consisting of the discharge roller 17 and the pinch roller 18 can be reduced. More specifically, in the fixing unit case, heated air may be accumulated due to the heat radiated from the heat roller 15 and vapor generated from the paper P may also be accumulated in the fixing unit case at the time of the fixing operation. The heated air and vapor may affect the sheet. For example, the vapor released from the sheet may be absorbed back into the sheet to render the sheet soggy, and sheet curling may easily occur. However, by providing a reduced volume of the space in the fixing unit case, heated air volume can be reduced, and vapor accumulation amount can be reduced. Consequently, the sheet passing through the sheet delivery path 70 is not subjected to high temperature and high humidity, thereby eliminating the occurrence of curling of the discharged paper P at the time of cooling due to discharge.

As shown in FIGS. 2, 3 and 10, at the upper portion of substantially vertically extending wall 41*a* in the vicinity of the outer peripheral surface of the pressure roller 16, a plurality of vapor escape holes 71 are formed. The array of the holes is directed in the direction of width of the paper P for escaping the vapor generated at the fixing part to the exterior. Further, in the top cover 7, a multiplicity of discharge orifices 72 are formed. Each array of the discharge orifices 72 is directed in a widthwise direction of the paper P for discharging the vapor which has been passed through the vapor escape holes 71 to the exterior of the printer.

Such an arrangement will allow the vapor generated at the fixing part of the fixing unit 4 to be upwardly moved by the upward flow of air and to be immediately discharged through the vapor escape holes 71 of the wall 41*a* to the exterior of the fixing unit 4 and then from the discharge orifices 72 to the exterior of the printer, thereby preventing the vapor from remaining within the case of the fixing unit 4 and from becoming condensed on the inner surface of the upper case 41, to thus eliminate such inconveniences that the excessive moisture is caused to be reabsorbed into the paper P passing from the fixing part through the delivery path 70 to the paper discharge part and that water droplet may drop on the surface of the paper P and moisten it.

In the Illustrated embodiment, the downward convex portion 73 at the intermediate part of the upper case 41 serves as a droplet reservoir 73. At a position above the droplet reservoir 73, a pair of transversely extending guide ribs 74 protrude downwardly (FIG. 3) from the lower surface of the top cover 7. Even if droplets genereated by the vapor condensation is flowed along the underside of the top cover 7, the flowed droplet can be blocked by the guide ribs 74, and does not reach the sheet discharge part. The droplet blocked by the guide ribs 74 can surely be dropped down onto the droplet reservior 73 and is accumulated therein.

Further, if necessary, a broad surface area of the paper discharge tray 8 may be formed with an air outlet 75 extending in the direction of width of the paper P as shown in FIG. 3. Such an arrangement will prevent vapor from being stored within the space defined between the discharge tray 8 and the top cover 7 even when the image formation and paper discharge is performed in such a manner that the discharge tray 8 is positioned in superposed relation with the top cover 7.

Moreover, as shown in FIG. 3, a vapor absorbing member 76 such as a sponge can be provided at a position immediately above the case 34 of the process unit 3, that is, at a lower surface of the top cover 7 at the downstream side of the sheet feed unit 5 in the sheet feed direction. The vapor absorbing member extends in a direction of width of the paper P and has an appropriate width in the direction of delivery of the paper P. Because of the provision of the vapor absorbing member 76, the vapor moving along the underside of the top cover 7 toward the sheet feed unit 5 can be trapped by the vapor absorbing member 76, thus preventing the vapor from dropping onto the surface of the paper P to be fed from the sheet feed unit 5.

Figure 11:
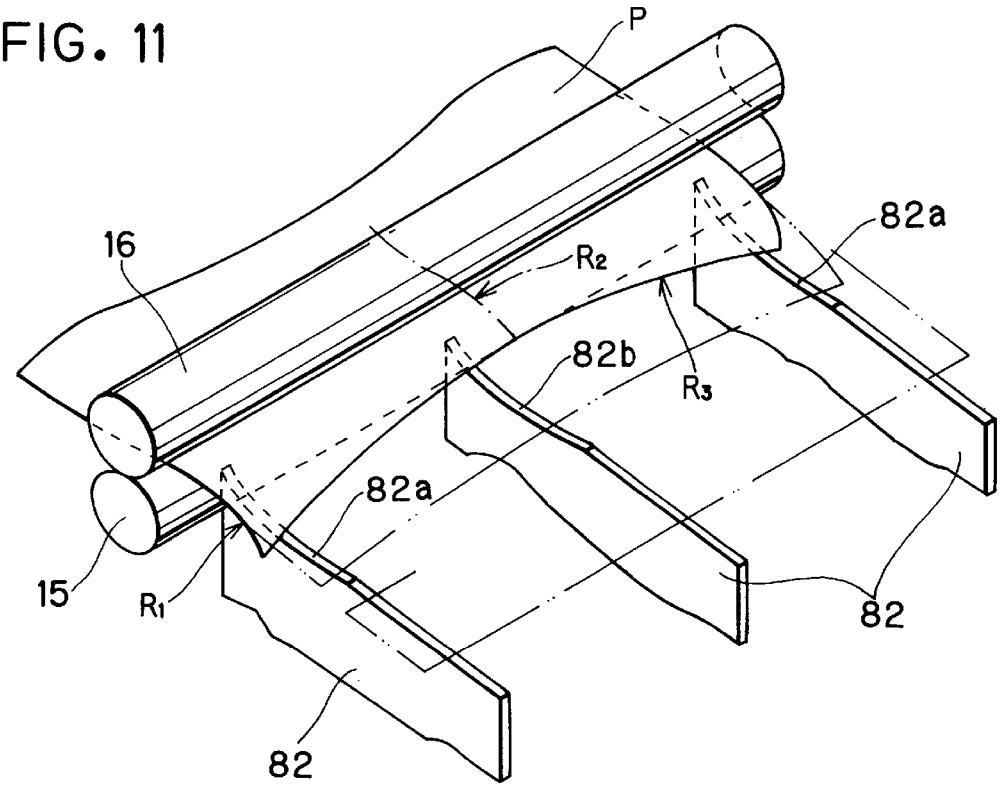
FIG. 11 is a schematic perspective view for description of sheet curling occurring as a result of passage of the sheet though the fixing unit.

As best shown in FIG. 11, a plurality of guide ribs 82 serving as sheet delivery guiding members may be provided on the sheet discharge side of the heat roller 15. The guide ribs 82 are spaced away from each other at appropriate intervals along the direction of width of the paper P. Each guide rib has an arcuate upper guide surface 82*a*, 82*b*. With this arrangement, the paper P discharged from the heat roller 15 can be desirably directed and guided by the upper guide surface 82*a*, 82*b* to the paper discharge part including the paper discharge rollers 17 and the pinch rollers 18 in such a manner that the leading edge of the paper P is in sliding contact with the upper guide surfaces 82*a*, 82*b* of the guide ribs 82.

Figures 9A, 9B, 9C, 9D:
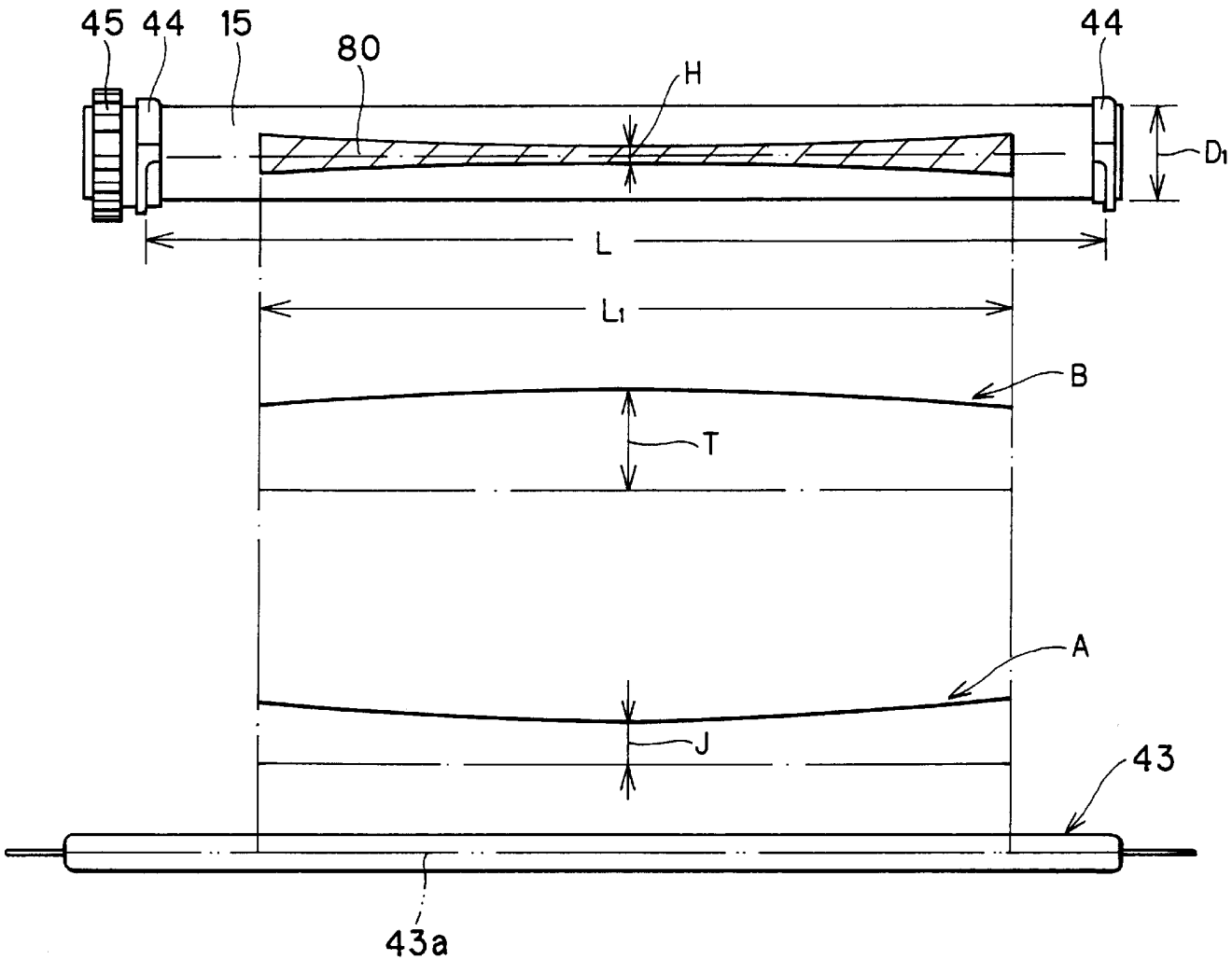
FIG. 9(*a*) is a plan view showing a distribution of nipping area of a heat roller with respect to the pressure roller.

FIG. 11 also shows the state of curling at the leading edge of the paper P after having passed through the nip between the heat roller 15 and the pressure roller 16. If the two rollers 15, 16 are of straight shaped cylinders with no crown, the heat roller 15 and the pressure roller 16 provide the greater pressure at the longitudinally end portions thereof than the longitudinally center portion because both the heat roller and the pressure roller are supported at their axially end portions. As a result, a nipping width H relative to the paper P defined by both the rollers 15 and 16 (the nipping width being directed in the direction orthogonal to the roller axes) is the smallest at the longitudinally center portion, and is increased toward the right and left end portions as best shown in FIG. 9(*a*). Thus, when the leading edge of the paper P is naturally released from the nip portion, due to the elasticity of the paper P itself, the radius of curvature R2 of an upwardly convex curl along the circumferential direction of the heat roller 15 at the widthwise center portion of the paper P becomes greater than the radius of curvature R1 of an upwardly convex curl along the circumferential direction of the heat roller 15 at the right and left end portions of the paper P. Thus, a curl having a radius of curvature R3 at the leading edge is formed due to the composite curls R1 and R2 in such a manner that the curl R3 has the highest portion at the widthwise center and the lowest portions at the widthwise edge. Therefore, the upper guide surfaces 82*a* and 82*b* of the guide rib 82 integrally formed with the lower case 42 serve to guide the leading edge of the curled paper P to the nip portion between the discharge roller 17 and the pinch roller 18.

Figure 4:
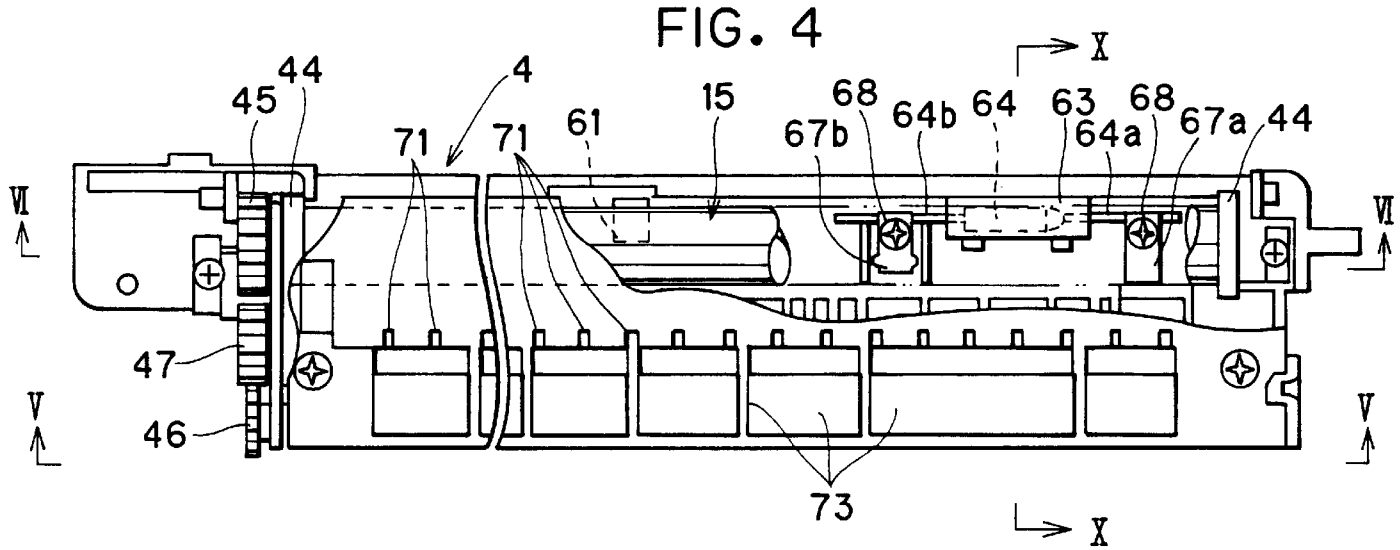
FIG. 4 is a plan view partially cut-away showing the fixing unit.
Figure 6:
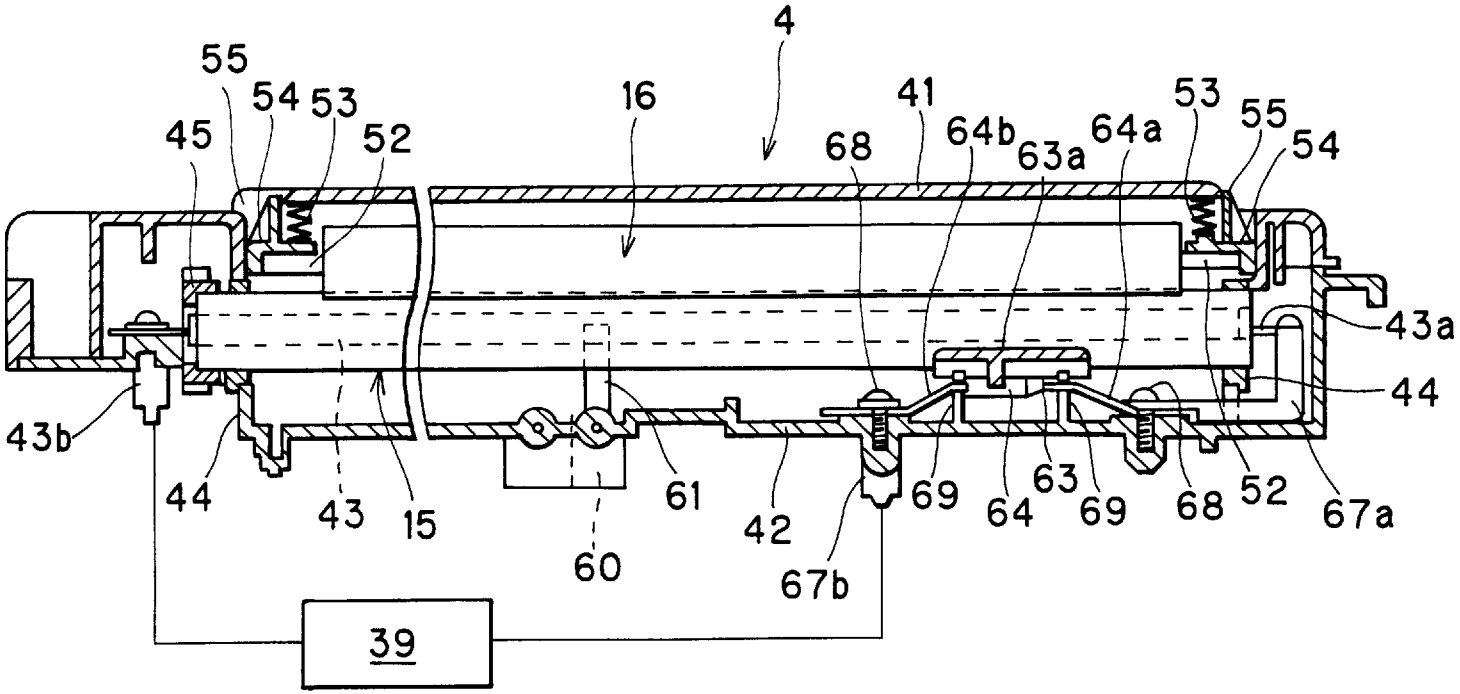
FIG. 6 is a cross-sectional view taken along the line VI—VI of FIG. 4.

Description will now be given with respect to a temperature control of the fixing unit 4. As shown in FIGS. 4 and 6, a thermistor (temperature sensor means) is fitted to a metallic resilient support member 61 extending from a socket 60 screwed onto the lower case 42 at substantially the central portion in the transverse direction. The thermistor is in contact with the outer peripheral surface of the heat roller 15 and senses the temperature of the peripheral surface of the heat roller 15. The thermistor is adapted to transmit signals to a controller (not shown) so as to controllably keep the temperature of the heat roller 15 at an ordinary operating temperature.

As shown in FIGS. 4 and 6, a temperature fuse 64 is disposed on the inner surface of one end portion of the lower case 42 at a predetermined creeping interval meeting the safety standards, thereby making it possible to provide a rapid response to the excessively heated state of the heat roller 15. To this end, a cover element 63 is fixedly supported to the inner surface of the lower case 42 and the temperature fuse 64 is fixed to the cover element 63. The cover element 63 is made of an electrically insulated material having a heat resistance such as ceramics or synthetic resin. The cover element 63 is formed to have dimensions larger than the length and thickness of the temperature fuse 64. The cover element 63 has a heat collecting surface 63*a* having a curvature in conformity with the outer peripheral surface of the heat roller 15. In order to dispose the heat collecting surface 63*a* in the vicinity of the outer peripheral surface of the heat roller 15 in a confronting manner, the cover element 63 is supported on a pair of right and left supports 69 projectingly and integrally formed on the inner surface of the lower case 42 and on the side of the underside of the heat roller 15 which is opposed to the direction in which the pressure roller 16 applies a pressure to the heat roller 15. The temperature fuse 64 is fixedly secured to the reverse side of the cover element 63 by way of a pair of holding clicks which are projectingly and integrally formed on that reverse side.

Lead wires 64*a*, 64*b* are respectively connected to respective ends of the temperature fuse 64, and are secured to a base provided in the lower case 42 by way of external terminals (metallic pieces) 67*a*, 67*b* and setscrews 68 as shown in FIGS. 4 and 6. The external terminal 67*a* on one hand is connected to one terminal 43*a* leading to the halogen lamp 43, whereas the external terminal 67*b* on the other is connected to the power supply part (primary circuit) 39, with the other terminal 43*b* of the halogen lamp 43 being connected to the power supply part 39. In this manner, the temperature fuse 64 is serially connected to the power supply circuit connecting the power supply part 39 to the halogen lamp 43 as shown in FIG. 6.

By virtue of such an arrangement, when the temperature of the heat roller 15 reaches an extraordinary high temperature, the ring-like bearings 44 made of heat-resistant thermoplastic synthetic resin at both ends of the heat roller 15 start to soften or melt. Since the heat roller 15 is always pressed by the pressure roller 16 as described above, the pressing force allows the heat roller 15 to approach the heat collecting surface 63*a* of the cover 63. Due to the softening or melting of the bearings 44, the outer peripheral surface of the heat roller 15 is finally brought into contact with the heat collecting surface 63*a* of the cover element 63. Thus, heat from the heat roller 15 is rapidly transmitted through the interior of the cover element 63 to the temperature fuse 64. Thus, the temperature fuse 64 is fused to promptly break the power supply from the power supply part 39 to the halogen lamp 43.

Next, detailed arrangement of the heat roller 15 and the pressure roller 16 will be described. The heat roller 15 is manufactured by die-drawing or extrusion molding of a tubular aluminum member and is in the form of a straight tube having uniform outer diameter D1 over the entire length thereof as shown in FIG. 9(*a*). In order to provide prompt heat transmission from the halogen lump 43 to the outer periphery of the heat roller 15, the outer diameter of the heat roller 15 is in a range of 16 mm to 20 mm, and a moment of inertia of area is in a range of 700 $mm^4$ to 1700 $mm^4$ to reduce the radial thickness of the hollow cylindrical member. Further, a thermal capacity of the heat roller 15 is set to be not more than 0.035 (J/K). Furthermore, the heat roller 15 preferably provides a thermal capacity of not more than $8.75 \times 10^{-5}$ (J) per consumed power (KW).

Table 1 shows the relationship of the maximum amount of deflection or bending (the amount of deflection at the longitudinal central point of the heat roller 15) of the heat roller 15 obtained when a pressing force from the straight pressure roller 16 with no crown is applied to the heat roller 15. The hear roller 15 has an axial length L of 245 mm measured between the right and left bearings 44 as shown in FIG. 9(*a*). Further, the heat roller 15 is a straight cylindrical sleeve provided with moment of inertia of area in the range of 600 $mm^4$ to 1800 $mm^4$. The maximum amount of deflection dependent on the pressure and the moment of inertia of area was measured. In this case, as shown in FIG. 9(*a*), the nip 80 has a nipping width H in a direction perpendicular to the axial direction of the roller is the smallest at the longitudinally center portion of the heat roller 15, and the nipping width H is gradually increased toward the ends of the heat roller 15.

As is apparent from the Table 1, if the moment of inertia of area in the straight heat roller 15 is small, the maximum deflection amount $H_{max}$(mm) increases accordingly as the pressing force W(kg/mm) becomes larger, resulting in a sharp inverse crown of the heat roller 15 on the side of the nip between the pressure roller 16 and the heat roller 15.

Further, if the moment of inertia of area of the heat roller is excessively small such as 600 $mm^4$, the radial thickness of the heat roller 15 becomes excessively small, and therefore, it becomes impossible to perform extrusion or drawing of the aluminum tube, nor forming an aluminum plate into a cylindrical shape and splicing the confronting edges by welding. Therefore, in order to prevent longitudinal wrinkles from occurring on the paper P, the maximum deflection amount of the heat roller 15 should be not more than 0.29 mm and the moment of inertia of area is in a range of 600 $mm^4$ to 1800 $mm^4$.

In case the value of the moment of inertia of area of the heat roller 15 is so large as 1800 $mm^4$ and in case the pressing force W is so a small value as 0.008 kg/mm to 0.01 kg/mm, defective fixing occurs due to a poor pressing force applied to the pressure roller 15 at the middle portion in the longitudinal direction thereof. To prevent this, a positive crown must be formed in advance on the heat roller 15.

On the contrary, too large a pressing force will result in a generation of elongated longitudinal wrinkles along the direction of feed at the middle portion of the paper P in the direction of width. Further, creeps may occur on the upper case 41 and the lower case 42 made of synthetic resin at the bearing portions of the pressure roller 16 and the heat roller 15 due to continuous pressing force. As a result, nipping force may be gradually decreased with the elapse of time.

Preferably, the metallic heat roller 15 is shaped into a cylinder extending parallel along the roller axis, the moment of inertia of area of the heat roller 15 is set to lie within a range of 700 $mm^4$ to 1700 $m^4$, and the maximum amount of deflection of the heat roller 15 at the middle portion in the longitudinal direction is set to be not more than 0.29 mm. More preferably, the pressing force of the pressure roller 16 against the heat roller 15 lies within a range of 0.01 kg/mm to 0.03 kg/mm.

Table 2 shows values ($mm^4$) of moment of inertia of area of the heat roller 15 depending on the roller outer diameter ranging from 12 mm to 20 mm of the heat roller 15 and the thickness ranging from 0.10 mm to 2.00 mm. As is apparent from the Table 2, if the outer diameter of the heat roller 15 is selected in the range of 16 mm to 20 mm, the thickness of the heat roller 15 can be in the range of 0.3 mm to 1.4 mm, which is available as manufacture of the metallic cylindrical member provided that the moment of inertia of aera of the heat roller 15 is in a range of 700 $mm^4$ to 1700 $mm^4$.

Further, Table 3 shows values of heat capacity (J/K) of the heat roller 15 depending on the roller outer diameter ranging from 12 mm to 20 mm of the heat roller 15 and the thickness ranging from 0.10 mm to 2.00 mm, where the aluminum heat roller 15 has the length of 245 mm between the right and left bearings 44 in the same manner as the above. Similar to the Table 2, the outer diameter of the heat roller 15 can selected in the range of 12 mm to 20 mm, and the thickness of the heat roller 15 can be selected in the range of 0.3 mm to 1.4 mm provided that the moment of inertia of area of the heat roller 15 is in a range of 700 $mm^4$ to 1700 $mm^4$.

Figure 12:
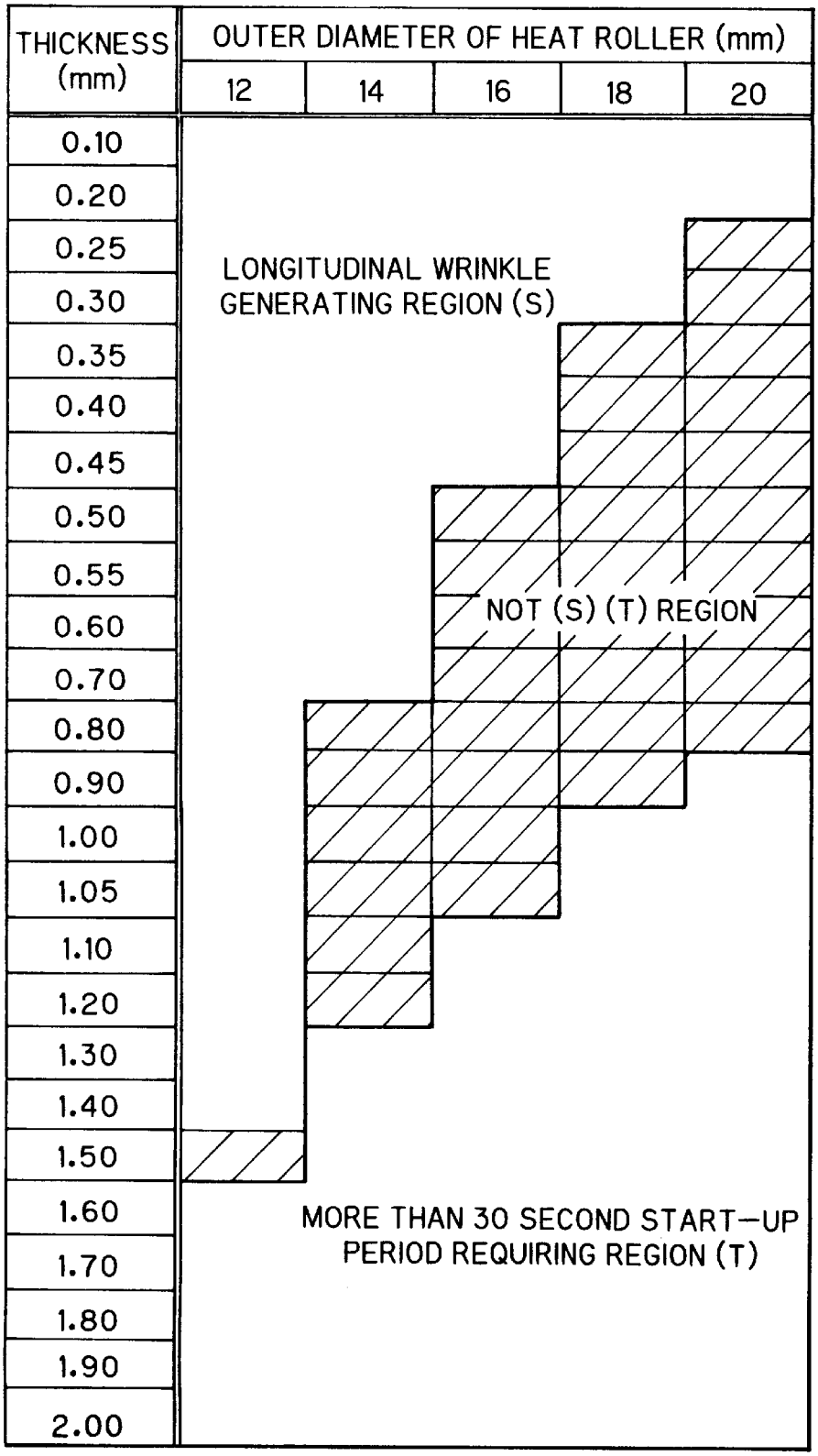
FIG. 12 is a view for determining allowable range of an outer diameter of the heat roller and radial thickness thereof, the range being capable of avoiding generation of wrinkles and prolonged start-up period exceeding over 30 seconds.

FIG. 12 shows a region T, a region S and a region NTS. In the region T, the warming-up or start-up period of the laser printer requires not less than 30 seconds. In the region S, longitudinal wrinkles appear on the paper P, and in the region NTS the start-up periods is within the 30 seconds, and longitudinal wrinkles do not appear on the paper P. An outer diameter (mm) of the heat roller 15 and the thickness (mm) are varied on the condition that the heat roller 15 has a constant length L=245 mm between the right and left bearings 44 and the surface temperature of the heat roller 15 is heated from 20°C. to 120°C. by means of a halogen lamp with a consumed power of 400 watts as the amount of heat radiation, with a pressing force of 2.5 kgf applied to the right and left end portions of the pressure roller 16.

As can be seen from FIG. 12, only when the dimension of thickness lies within a proper range, i.e., the NTS region, relative to the outer diameter of the heat roller 15, no longitudinal wrinkles on the paper P occurs and the start-up period is within 30 seconds.

FIG. 9(*a*) shows a variation in a nipping width H of a nip area 80 defined between the heat roller 15 and the pressure roller 16. The nipping width H is directed in parallel with the sheet feeding direction, and the nip area has a nipping length L1 which is slightly larger than a maximum width of the paper P to be used. Further, the nipping length L1 is smaller than the length of the pressure roller 16. The nip area 80 provides such configuration that a longitudinally center portion of the nipping width H is the smallest, and the nipping width H is gradually increased toward each end of the heat roller 15. Such contour is formed on the condition that the outer diameter and a radial thickness of the heat roller 15 are small, and the heat roller 15 is pressed with a predetermined pressing force by the pressure roller 16 having an outer diameter slightly larger than that of the heat roller 15.

FIG. 9(*d*) illustrates the halogen lamp 43 (power consumption 400 W) serving as a heating element which supplies a thermal energy J to the heat roller 15 in accordance with a luminous intensity distribution curve A (a heat distribution curve) shown in FIG. 9(*c*). The halogen lamp 43 includes a linear heat radiation element such as a tungsten filament 43*a* which is hermetically disposed within the internal space portion. As can be seen from the luminous intensity distribution curve A, the thermal energy distribution is so set that a minimum thermal energy J appears in substantially the middle of the dimension L1 of length of the nip and that the thermal energy J becomes larger toward the right and left end portions.

FIG. 9(*b*) illustrates a temperature distribution curve B with respect to the outer peripheral surface of the heat roller 15 which is heated with a thermal energy J in accordance with the luminous intensity distribution curve A of FIG. 9

(*c*). The temperature distribution curve B is so set that a maximum temperature T appears in substantially the middle of the dimension L1 of length of the nip and that the temperature T is gradually lowered toward the right and left end portions. Since the amount of heat radiation or release -from the right and left end portions of the tubular heat roller 15 is greater than that from the central portion, the temperature distribution curve B can be so set that a maximum value of temperature T appears in substantially the middle of the dimension L1 of length of the nip and that the temperature T becomes lower toward the right and left end portions, irrespective of the fact that the luminous intensity distribution curve (heat distribution curve) A indicates its minimum value in substantially the middle of the dimension L1 of length of the nip and becomes higher toward the right and left end portions.

With such an arrangement shown in FIGS. 9(*a*) through 9 (*c*), uniform amount of heat per unit area can be imparted onto the sheet P along the direction of axis of the heat roller 15, thereby ensuring a substantially constant fixing strength along the width of the paper P. This philosophy indicates that the nipping width H is inversely proportional to the temperature T, that is, a small nipping width is available at the high temperature portion, and a large nipping width is available at the low temperature portion.

Furthermore, because the amount of heat per unit area to be supplied to the paper P is substantially uniform along the direction of axis of the heat roller 15, excessive curling of the paper P is avoidable at widthwise end portions of the paper P.

FIG. 13 shows a level of curling which may occur on the paper P depending on variations in diameters (ranging from 7 mm to 11 mm) of the core member 50 of the pressure roller 16 and on rubber hardness (8 to 22 JISA) of the elastic layer 51 such as a vulcanized rubber layer formed over the core member 50. Regarding the heat roller 15, the length L between the right and left bearings 44 was 245 mm, and the outer diameter was 16 mm, and the radial thickness was 0.6 mm. Regarding the pressure roller 16, the outer diameter was 16.5 mm and a pressing force was 2.5 kgf applied to each right and left end portions of the pressure roller 16. In FIG. 13, ◎ indicates scarcely occurrence of the curl, ○ indicates moderate curl, Δ indicates slightly steep curl, and X indicates excessively curved curl.

As can be understood from FIG. 13, the curling tends to become gentle accordingly as the diameter of the core member 50 increases and the rubber hardness of the elastic layer 51 is higher. This is due to the fact a higher rubber hardness results in a smaller nipping width H of the nip area 80, so that tendency for winding the paper P around the heat roller 15 is lowered.

Similarly, FIG. 14 shows a level of strength of fixing to the paper P in the same conditions as in FIG. 16 above. The rubber hardness herein is in accordance with the JIS standard (K6310-1975: physical testing method for vulcanized rubber) and was measured by the employment of a type A spring-loaded hardness tester. The hardness is referred to as "JISA hardness". In FIG. 14 ◎ indicates excellent fixing quality, ○ indicates good fixing quality, Δ indicates slightly bad quality, and X indicates bad quality.

As can be seen from FIG. 14, the strength of fixing to the paper P is increased accordingly as the diameter of the core member 50 is reduced and the rubber hardness of the elastic layer 51 is also reduced. This is due to the fact that with a predetermined pressing force from the pressure roller 16, a lower rubber hardness will result in a relatively larger nipping width H, thereby elongating heating and pressing area against the toner resting on the paper P.

Thus, a satisfactory range ensuring a generation of gentle curl and a sufficient fixing strength is of the order of 8 mm to 10 mm in the outer diameter of the core member 50 and of the order of 12 to 20 in rubber hardness. A preferable dimension of thickness of the elastic layer 51 can be calculated by subtracting the preferable outer diameter of the core member 50 from the preferable outer diameter (for example 16 mm) of the pressure roller 16. The calculation falls that the radial thickness of the elastic layer 51 is in a range of 3 mm to 6 mm.

FIG. 15 shows a level of the fixing properties and the curling experimentally obtained depending on variations in outer diameter of the pressure roller 16. The experimental condition is such that the power consumption of the halogen lamp 43 was 400 watts and the predetermined pressing force of 2.5 kgf was applied to each right and left end portions of the pressure roller 16 to apply pressure to the heat roller 15. Regarding the heat roller 15, a length L between the right and left bearings 44 was 245 mm, an outer diameter was 16 mm, and radial thickness was 0.6 mm. As can be understood from FIG. 15, in order to ensure satisfactory fixing properties and curling levels, the preferable outer diameter of the pressure roller 16 should be in a range of 16 mm to 20 mm. In FIG. 15 ◎ indicates excellent fixing quality and extremely moderate curl, ○ indicates good fixing quality and relatively moderate curl, Δ indicates slightly bad fixing quality and relatively steep curl, and X indicates bad fixing quality and extreme curling.

If the outer diameter of the heat roller 15 is not more than 16 mm, and the outer diameter of the pressure roller 16 is in the range of 16 mm to 20 mm, the difference in outer diameters between the two rollers is not excessive. Consequently, there is not so large a difference between frictional forces of the paper P relative to the two rollers. Therefore, the paper P is not subjected to a slippage at the nip 80 between the heat roller 15 and the pressure roller 16, thereby obviating the problem of occurrence of defective image in which the resultant toner image has a frictional trace or scratch.

Also, in order to secure proper fixing properties, the nipping width H is at least 1 mm since it becomes minimum at the middle portion in the longitudinal direction of the heat roller 15. Preferable nipping width is in a range of 1.5 mm to 2.5 mm.

By properly selecting numeral values of the heat roller 15 and the pressure roller 16, a satisfactory toner image can be formed on the paper P while reducing the curling which may occur on the paper P. In addition, a temperature rising speed until reaching the use temperature after turning ON the printer can be accelerated, thereby ensuring a prompt start of image forming operation as well as a reduced power consumption of the halogen lamp 43, and further, lower running cost results.

It is to be appreciated that even if the pressure roller has a positive crown shape, the straight heat roller 15 can be used so as to provide an inverse crown ditribution of the nip area by applying appropriately small value of pressing force.

As described above, according to the illustrated embodiment, the following advantages are conceivable.

Drawing or extruding process is available for forming the metalic heat roller by making the heat roller in the form of the cylindrical sleeve without any crown. Thus, production cost can be greatly reduced. By providing the moment of inertia of area ranging from 700 $mm^4$ to 1700 $mm^4$ in the heat roller, small outer diameter of the heat roller is available, or thickness of the sleeve member can be reduced. Accordingly, thermal capacity of the entire heat roller can be reduced to not more than 0.035 J/K, so that heat conduction period for transmitting heat from the heating element such as the halogen lamp to the outer peripheral surface of the sleeve member can be shortened. Thus, warming-up period (period for increasing the temperature of the heat roller from its room temperature to the necessary image fixing temperature) can be reduced, and consequently, image forming operation can be started with a reduced waiting time after turning ON the main switch.

If the maximum deflection occurring at the longitudinal center portion of the heat roller is not more than 0.29 mm due to the pressure applied from the pressure roller having a crown shape or linear cylindrical shape, or if the pressure roller provides a pressure force to the heat roller ranging from 0.01 kg/mm to 0.03 kg/mm, proper nipping similar to a nipping provided by the employment of the inverted crown shape of the heat roller can be provided in relation with the pressure roller because of the deflection in spite of the employment of the linear cylindrical heat roller. Thus, proper fixing performance can be provided without occurrence of longitudinal wrinkles in the image recording sheet.

If the pressure roller provides a pressure force to the heat roller, the pressure force ranging from 0.01 kg/mm to 0.03 kg/mm, or if the heat roller has a radial thickness ranging from 0.1 mm to 2.0 mm, the outer diameter, the radial thickness and axial length of the heat roller can be easily selected in an attempt to provide the maximum deflection occurring at the longitudinal center portion of the heat roller within the range of not more than 0.29 mm. Because the pressure force is not excessively large, creep phenomena at the bearing portion of the pressure roller and the heat roller can be obviated. Accordingly, it is unnecessary to use expensive materials having high strength, thereby reducing production cost.

If the pressure roller has a cylindrical shape and has a peripheral surface extending in parallel with the center axis thereof, economical pressure roller results. Further, even if the pressure roller has a normal crown shape, the linear cylindrical heat roller can be used by properly setting a moment of inertia of area of the heat roller, maximum deflection amount thereof and pressure from the pressure roller.

Because of the low thermal capacity of the heat roller, the heating element requires less consumed power, to provide economical running cost. If the heat roller has an outer diameter ranging from 12 mm to 20 mm, a compact heat roller results to render the fixing device compact, and warming-up period can be reduced to further reduce running cost. Further, if the heat roller provides a thermal capacity of not more than $8.75\times10^{-5}$ (J) per consumed power (KW), warming-up period can further be reduced to further lower running cost.

If the pressure roller includes the core member and the elastic layer formed on the outer peripheral surface of the core member, and the elastic layer has a rubber hardness ranging from 12 to 20 degrees in JISA hardness standard, a desirable nipping width can be obtained in relation with the heat roller as far as a proper pressure force is applied even if the hollow cylindrical heat roller has a thin radial thickness. Consequently, excessive curling does not occur in the image recording sheet after image fixing operation.

If the heat roller has the outer diameter not more than 16 mm, and if pressure roller has an outer diameter ranging from 16 mm to 20 mm, prompt heat transmission results from the heating element to the outer peripheral surface of the heat roller, to reduce warming-up period of the fixing device. Further, because of the small diameter of the pressure roller, the nipping width is not excessively large, so that curling curvature of the sheet can become moderate.

If the core member has a diameter ranging from 8 mm to 10 mm, and the elastic layer has a radial thickness ranging from 3 mm to 6 mm, outer diameter of the pressure roller can be reduced, and optimum nipping width can be provided.

If the heat roller has the outer diameter smaller than the outer diameter of the pressure roller, a desired nipping width can be provided to restrain sheet curling, and image fixing strength can be enhanced.

If the heat roller has an outer diameter not more than 16 mm, and the pressure roller has an outer diameter ranging from 16 mm to 20 mm, the outer diameters of these rollers are not quite different from each other, slippage of the image recording sheet does not occur at the nip portion, while providing the desired nipping. Thus, high quality image can be provided.

If the pressure roller and the heat roller provide the nipping area whose width in a direction perpendicular to the center axes of these rollers is not less than 1 mm, a desired nipping width can be obtained in spite of the employment of the compact heat roller and the pressure roller. Thus, resultant sheet curl does not provide excessive curvature.

By providing the inversely proportional relationship between the nipping width distribution and the temperature distribution of the outer peripheral surface of the hear roller, the amount of heat imparted to the printing paper becomes uniform along the direction of roller axis of the heat roller. Accordingly, uniform fixing strength for fixing the toner to the sheet can be obtained in the widthwise direction thereof, to thus provide a satisfactory imaging quality. Further, since the amount of heat hardly varies along the direction of width of the image recording medium to be recorded, there can be suppressed the curling.

While the invention has been described in detail and with reference to the specific embodiment thereof, it would is be apparent to those skilled in the art that various changes and modifications may be made therein without departing from the sprit and scope of the invention. For example, other than the type of transferring toner images from the photosensitive drum 23, the toner image forming means of the present invention may be a type having a multiplicity of back electrodes confronting a multiplicity of openings in the direction transverse to the paper delivery direction in the electrode array. In this case, toner images are formed on the surface of a medium to be recorded passing through the gap defined between the openings and the back electrodes, by directly immigrating the toner through the openings selectively by the application of voltage to the aperture electrodes associated with the openings on the basis of image data.

TABLE 1

| PRESSURE | MOMENT OF INERTIA OF AREA ($mm^4$) | | | | | |
|---|---|---|---|---|---|---|
| W (kg/mm) | 600 | 700 | 1000 | 1200 | 1700 | 1800 |
| 0.008 | 0.087 | 0.074 | 0.052 | 0.043 | 0.031 | 0.029 |
| 0.01 | 0.109 | 0.093 | 0.065 | 0.054 | 0.038 | 0.036 |
| 0.02 | 0.217 | 0.186 | 0.130 | 0.109 | 0.077 | 0.072 |
| 0.03 | 0.326 | 0.279 | 0.195 | 0.163 | 0.115 | 0.109 |
| 0.04 | 0.434 | 0.372 | 0.261 | 0.217 | 0.153 | 0.145 |
| 0.05 | 0.543 | 0.465 | 0.326 | 0.271 | 0.192 | 0.181 |

TABLE 1-continued

| PRESSURE | MOMENT OF INERTIA OF AREA ($mm^4$) | | | | | |
|---|---|---|---|---|---|---|
| W (kg/mm) | 600 | 700 | 1000 | 1200 | 1700 | 1800 |
| 0.06 | 0.652 | 0.559 | 0.391 | 0.326 | 0.230 | 0.217 |
| 0.07 | 0.760 | 0.652 | 0.456 | 0.380 | 0.268 | 0.253 |
| 0.08 | 0.869 | 0.745 | 0.521 | 0.434 | 0.307 | 0.290 |

(MAXIMUM DEFLECTION AMOUNT, (mm))

TABLE 2

| THICKNESS | OUTER DIAMETER OF HEAT ROLLER (mm) | | | | |
|---|---|---|---|---|---|
| (mm) | 12 | 14 | 16 | 18 | 20 |
| 0.10 | 66.18 | 105.47 | 157.89 | 225.23 | 309.48 |
| 0.30 | 188.81 | 303.08 | 456.08 | 653.47 | 900.91 |
| 0.50 | 299.19 | 483.76 | 731.94 | 1053.17 | 1456.86 |
| 0.70 | 398.16 | 648.51 | 986.60 | 1425.63 | 1978.79 |
| 0.90 | 486.54 | 798.29 | 1221.16 | 1772.12 | 2468.12 |
| 1.00 | 527.00 | 867.86 | 1331.25 | 1936.01 | 2700.98 |
| 1.20 | 600.95 | 996.95 | 1537.70 | 2245.84 | 3143.99 |
| 1.40 | 666.22 | 1113.34 | 1726.72 | 2532.74 | 357.79 |
| 1.50 | 695.81 | 1167.05 | 1815.01 | 2667.95 | 3754.15 |
| 1.60 | 723.50 | 1217.91 | 1899.31 | 2797.86 | 3943.71 |
| 1.80 | 773.48 | 1311.49 | 2056.46 | 3042.33 | 4303.03 |
| 2.00 | 816.81 | 1394.87 | 2199.11 | 3267.26 | 4636.99 |

(MOMENT OF INERTIA OF AREA ($mm^4$))

TABLE 3

| THICKNESS | OUTER DIAMETER OF HEAT ROLLER (mm) | | | | |
|---|---|---|---|---|---|
| (mm) | 12 | 14 | 16 | 18 | 20 |
| 0.10 | 0.00255 | 0.00298 | 0.00341 | 0.00384 | 0.00427 |
| 0.30 | 0.00753 | 0.00881 | 0.0101 | 0.0114 | 0.0127 |
| 0.50 | 0.0123 | 0.0145 | 0.0166 | 0.0188 | 0.0209 |
| 0.70 | 0.0170 | 0.0200 | 0.0230 | 0.0260 | 0.0290 |
| 0.90 | 0.0214 | 0.0253 | 0.0291 | 0.0313 | 0.0369 |
| 1.00 | 0.0236 | 0.0279 | 0.0322 | 0.0365 | 0.0407 |
| 1.20 | 0.0278 | 0.0329 | 0.0381 | 0.0432 | 0.0484 |
| 1.40 | 0.0318 | 0.0378 | 0.0438 | 0.0498 | 0.0558 |
| 1.50 | 0.0338 | 0.0402 | 0.0466 | 0.0531 | 0.0595 |
| 1.60 | 0.0357 | 0.0426 | 0.0494 | 0.0563 | 0.0631 |
| 1.80 | 0.0394 | 0.0471 | 0.0548 | 0.0625 | 0.0703 |
| 2.00 | 0.0429 | 0.0515 | 0.0601 | 0.0686 | 0.0772 |

(THERMAL CAPACITY (J/K))

What is claimed is:

1. A fixing device for thermally fixing a toner image formed on an image recording medium, the fixing device comprising:

a heat roller comprising a sleeve member formed of a metal, the sleeve member having an inner hollow space and defining a longitudinal center, and a heating element provided in the hollow space, the sleeve member providing a moment of inertia of area ranging from 700 $mm^4$ to 1700 $mm^4$ and a maximum deflection amount of not more than 0.29 at the longitudinal center; and a pressure roller in pressure contact with the heat roller for nipping the image recording medium between the heat roller and the pressure roller.

2. The fixing device as claimed in claim 1, wherein the pressure roller provides a pressure force to the heat roller, the pressure force ranging from 0.01 kg/mm to 0.03 kg/mm.

3. The fixing device as claimed in claim 1, wherein the pressure roller has a cylindrical shape and has a center axis, the pressure roller having a peripheral surface extending in parallel with the center axis.

4. The fixing device as claimed in claim 1, wherein the pressure roller has a normal crown shape in which a diameter at a longitudinally center portion is maximum and a diameter is gradually reduced toward longitudinal end portions.

5. The fixing device as claimed in claim 1, wherein the pressure roller comprises a core member having an outer peripheral surface, and an elastic layer formed on the outer peripheral surface of the core member, the elastic layer having a rubber hardness ranging from 12 to 20 degrees in JISA hardness standard.

6. The fixing device as claimed in claim 5, wherein the sleeve member of the heat roller has an outer diameter not more than 16 mm, and wherein the pressure roller has an outer diameter ranging from 16 mm to 20 mm.

7. The fixing device as claimed in claim 5, wherein the core member has a diameter ranging from 8 mm to 10 mm, and wherein the elastic layer has a radial thickness ranging from 3 mm to 6 mm.

8. The fixing device as claimed in claim 1, wherein the sleeve member of the heat roller has an outer diameter smaller than an outer diameter of the pressure roller.

9. The fixing device as claimed in claim 8, wherein the heat roller has an outer diameter not more than 16 mm, and wherein the pressure roller has an outer diameter ranging from 16 mm to 20 mm.

10. The fixing device as claimed in claim 8, wherein the heat roller and the pressure roller have center axes, and wherein the pressure roller and the heat roller provides a nipping area whose width in a direction perpendicular to the center axes is not less than 1 mm.

11. The fixing device as claimed in claim 1, wherein the sleeve member provides a temperature gradient at an outer surface thereof such that a temperature at the longitudinal center is the highest and temperature is gradually reduced toward longitudinal end portions of the sleeve member.

12. The fixing device as claimed in claim 11, wherein the sleeve member of the heat roller has an outer diameter ranging from 16 mm to 20 mm.

13. The fixing device as claimed in claim 11, wherein the pressure roller provides a pressure force to the heat roller, the pressure force ranging from 0.01 kg/mm to 0.03 kg/mm.

14. The fixing device as claimed in claim 11, wherein the heat roller and the pressure roller have longitudinal axes, and wherein the pressure roller and the heat roller provides a nipping area having a nipping width in a direction perpendicular to the longitudinal axes, a nipping width at a longitudinally center portion of these rollers being smaller than that at longitudinally end portions thereof.

15. The fixing device as claimed in claim 1, wherein the sleeve member provides a thermal capacity of not more than 0.035 (J/K).

16. A fixing device for thermally fixing a toner image formed on an image recording medium, the fixing device comprising:

a heat roller comprising a thin sleeve member formed of a metal, the sleeve member having an inner hollow space, and, a heating element provided in the hollow space, the sleeve member providing a moment of inertia of area ranging from 700 $mm^4$ to 1700 $mm^4$ and a thermal capacity of not more than 0.035 (J/K); and a pressure roller in pressure contact with the heat roller for nipping the image recording medium between the heat roller and the pressure roller.

17. The fixing device as claimed in claim 16, wherein the sleeve member has an outer diameter ranging from 12 mm to 20 mm.

18. The fixing device as claimed in claim 16, wherein the sleeve member has a radial thickness ranging from 0.1 mm to 2.0 mm.

19. The fixing device as claimed in claim 16, wherein the pressure roller provides a pressure force to the heat roller, the pressure force ranging from 0.01 kg/mm to 0.03 kg/mm.

20. The fixing device as claimed in claim 16, wherein the heat roller provides a thermal capacity of not more than $8.75\times10^{3}$ (J) per consumed power (KW).

21. The fixing device as claimed in claim 16, wherein the pressure roller comprises a core member having an outer peripheral surface, and an elastic layer formed on the outer peripheral surface of the core member, the elastic layer having a rubber hardness ranging from 12 to 20 degrees in JISA hardness standard.

22. The fixing device as claimed in claim 21, wherein the sleeve member of the heat roller has an outer diameter not more than 16 mm, and wherein the pressure roller has an outer diameter ranging from 16 mm to 20 mm.

23. The fixing device as claimed in claim 21, wherein the core member has a diameter ranging from 8 mm to 10 mm, and wherein the elastic layer has a radial thickness ranging from 3 mm to 6 mm.

24. The fixing device as claimed in claim 16, wherein the sleeve member of the heat roller has an outer diameter smaller than an outer diameter of the pressure roller.

25. The fixing device as claimed in claim 24, wherein the heat roller has an outer diameter not more than 16 mm, and wherein the pressure roller has an outer diameter ranging from 16 mm to 20 mm.

26. The fixing device as claimed in claim 24, wherein the heat roller and the pressure roller have center axes, and wherein the pressure roller and the heat roller provides a nipping area whose width in a direction perpendicular to the center axes is not less than 1 mm.

27. The fixing device as claimed in claim 16, wherein the sleeve member provides a temperature gradient at an outer surface thereof such that a temperature at the longitudinal center is the highest and temperature is gradually reduced toward longitudinal end portions of the sleeve member.

28. The fixing device as claimed in claim 27, wherein the sleeve member of the heat roller has an outer diameter ranging from 16 mm to 20 mm.

29. The fixing device as claimed in claim 27, wherein the pressure roller provides a pressure force to the heat roller, the pressure force ranging from 0.01 kg/mm to 0.03 kg/mm.

30. The fixing device as claimed in claim 27, wherein the heat roller and the pressure roller have longitudinal axes, and wherein the pressure roller and the heat roller provides a nipping area having a nipping width in a direction perpendicular to the longitudinal axes, a nipping width at a longitudinally center portion of these rollers being smaller than that at longitudinally end portions thereof.

* * * * *